US007263845B2

(12) United States Patent
Lee

(10) Patent No.: US 7,263,845 B2
(45) Date of Patent: Sep. 4, 2007

(54) BACKUP CRYOGENIC REFRIGERATION SYSTEM

(75) Inventor: Ron Clark Lee, Bloomsbury, NJ (US)

(73) Assignee: The BOC Group, Inc., Murray Hill, NJ (US)

( * ) Notice: Subject to any disclaimer, the term of this patent is extended or adjusted under 35 U.S.C. 154(b) by 162 days.

(21) Appl. No.: 10/953,030

(22) Filed: Sep. 29, 2004

(65) Prior Publication Data

US 2006/0065004 A1 Mar. 30, 2006

(51) Int. Cl.
*F25B 1/00* (2006.01)

(52) U.S. Cl. ..... 62/115; 62/333

(58) Field of Classification Search ..... 62/45.1, 62/51.1, 50.7, 333, 434, 115; 174/15.1, 15
See application file for complete search history.

(56) References Cited

U.S. PATENT DOCUMENTS 3,946,141 A 3/1976 Schmidt
3,950,606 A 4/1976 Schmidt
4,020,274 A 4/1977 Dean
4,020,275 A 4/1977 Dean
4,176,238 A 11/1979 Vulis et al.
4,541,248 A * 9/1985 Andrepont et al. ..... 62/48.2
5,042,262 A * 8/1991 Gyger et al. ..... 62/64
5,615,557 A * 4/1997 Binneberg et al. ..... 62/51.1
5,858,386 A 1/1999 Levy
6,342,673 B1 1/2002 Verhaege et al.
6,354,087 B1 * 3/2002 Nakamura et al. ..... 62/6
6,512,311 B1 1/2003 Metra et al.
6,609,383 B1 * 8/2003 Kusada et al. ..... 62/51.2
6,622,494 B1 * 9/2003 Pourrahimi ..... 62/51.1
6,640,557 B1 * 11/2003 Arman et al. ..... 62/50.7
6,854,276 B1 2/2005 Yuan et al.
7,009,104 B2 * 3/2006 Spreafico ..... 174/15.5

FOREIGN PATENT DOCUMENTS

EP 1 355 114 A2 10/2003
JP 10-73333 A * 3/1998

* cited by examiner

*Primary Examiner*—Mohammad M. Ali
(74) *Attorney, Agent, or Firm*—Philip H. Von Neida

(57) ABSTRACT

Backup refrigeration is provided to a cryogenic refrigeration system comprising multiple cooling loops using a single backup coolant storage vessel. The backup coolant storage vessel is in fluid communication with at least one of the cooling loops, and the cooling loops are in fluid communication with each other. Each cooling loop, in turn, is in fluid communication with a refrigeration unit. In the event of lost coolant from one of the loops, coolant, e.g., liquid nitrogen, is transferred from the other loops to the loop that lost coolant, and the backup coolant storage vessel releases backup coolant into the system.

21 Claims, 4 Drawing Sheets

SIMPLE COUNTER-FLOW HEAT EXCHANGER

BACKUP CRYOGENIC REFRIGERATION SYSTEM

FIELD OF THE INVENTION

This invention relates to cryogenic refrigeration systems. In one aspect, the invention relates to a backup or reserve system for a cryogenic refrigeration system while in another aspect, the invention relates to a backup system for a cryogenic refrigeration system for high temperature superconducting (HTS) cables. In yet another aspect, the invention relates to a method of providing backup cryogenic refrigeration capability to a cryogenic refrigeration system.

BACKGROUND OF THE INVENTION

Cryogenic refrigeration systems for High Temperature Superconducting (HTS) devices are well known. In one basic form, these systems comprise a cooling loop, a refrigeration unit and a coolant. The cooling loop, e.g., a configuration of pipe or other conduit, is arranged about a device that requires cooling, e.g., an HTS cable, and the loop is in fluid communication with the refrigeration unit. The refrigeration unit is a mechanical refrigeration device that is well known in the industry. Coolant, e.g., liquid nitrogen, flows from the refrigeration unit into the cooling loop, circulates through the cooling loop extracting heat from the device, and then returns to the refrigeration unit for removal of the heat and circulates back to the cooling loop.

Cryogenic refrigeration systems may be equipped with a backup or reserve refrigeration unit in the event the primary unit fails. Providing such complete redundancy in the event of the failure or routine maintenance of the refrigeration unit is generally not cost effective and adds complexity and physical size to the system.

Cryogenic refrigeration systems comprising two or more cooling loops, such as those used in connection with an HTS cable, would typically require one backup refrigeration unit per cooling loop. While effective, having one backup unit for each cooling loop adds to the capital expense of the overall refrigeration system and to its complexity of operation.

HTS power or transmission cables are also well known. These cables require cryogenic cooling, and representative HTS power or transmission cables are described in U.S. Pat. Nos. 3,946,141, 3,950,606, 4,020,274, 4,020,275, 4,176,238 and more recently, U.S. Pat. Nos. 5,858,386, 6,342,673 and 6,512,311. The configuration of a typical HTS cable is an HTS conductor or conductors cooled by liquid nitrogen flowing through either the hollow conductor core or in a fluid passage around the outside of the conductor(s). The attractiveness of HTS cables over conventional cables of the same size is that the former can carry multiple times the power than the latter, with almost no loss of electrical capacity.

The normal mode of cooling an HTS cable is to provide a mechanical refrigeration unit, known in the industry, to cool a closed loop of purely subcooled liquid nitrogen. "Subcooled" liquid nitrogen is nitrogen cooled to a temperature below its boiling point, which depends on the operating pressure. For example, at a closed loop operating pressure of 5 bar,abs the boiling point of liquid nitrogen is 94K. At a typical coolant temperature of from 70-75K, the liquid nitrogen would be subcooled in an amount of 19 to 24 degrees. Typically, a single subcooled liquid loop cannot cool the entire length of the cable and, accordingly, there must be multiple manageable segments. In present arrangements, backup refrigeration capability is provided, if at all, on an individual segment basis. Illustrative is the HTS cable and cooling system described in EP 1,355,114 A2.

The HTS cable and cryogenic cooling system of EP '114 comprises first and second cooling channels (4,5) about an HTS cable. Liquid nitrogen is circulated through these channels in which it picks up heat from the cables, passes to a low pressure, boiling liquid nitrogen bath (9), i.e., a subcooler, in which the heat is removed from it, and then it is circulated back to the channels. If liquid nitrogen is lost from the system for any reason, makeup nitrogen is added to the system from a storage tank (1). The storage tank and its connecting hardware is designed to provide initial nitrogen required to charge, and replenish as necessary, the cooling system. The storage tank also provides the coolant required for initial cable cool down through a liquid and gaseous nitrogen mixing system.

SUMMARY OF THE INVENTION

According to this invention, backup refrigeration is provided to a cryogenic refrigeration system comprising multiple cooling loops using a single backup refrigeration vessel. The backup refrigeration vessel is in fluid communication with at least one of the cooling loops, and the cooling loops are in fluid communication with each other. Each cooling loop, in turn, is in fluid communication with a refrigeration unit. The source of refrigeration for the unit can be either mechanical, e.g., a helium-cycle refrigeration system, or through the bulk vaporization of a liquefied gas, e.g., liquid nitrogen. In operation, a liquid coolant, e.g., liquid nitrogen, is circulated through each cooling loop which is configured through or about a device that requires cooling, e.g., a cable, and is circulated to a refrigeration unit for removal of heat or re-condensing before return to the cooling loop. If coolant is lost from one or more loops for whatever reason, then coolant is transferred from the other loops connected, directly or indirectly, to the loop that lost coolant, and backup coolant is released from the storage vessel into the loop or loops directly connected to the vessel. This addition of backup coolant is accomplished while the cryogenic refrigeration system continues to operate.

In one embodiment, the liquid coolant is stored in a single vessel that incorporates a normal pressure building coil. Optionally, the vessel may also incorporate a re-condensing coil which is controlled to maintain the upper pressure desired in the vessel without allowing any of the vessel contents to be lost. With the optional re-condensing coil, the liquid coolant backup can be maintained for an indefinite period of time without any loss or requirements for replenishment.

In another embodiment, the backup liquid coolant vessel (i) is connected to subcooled liquid coolant loops, (ii) serves as a buffer vessel for the normal operation of the loops, and (iii) maintains these loops at a preferred pressure. The individual subcooled segment loops do not, in normal operation, transfer coolant between one another. Rather, each loop is maintained at the same nominally constant pressure. However, when one or more cooling loop segments loses coolant for any reason, makeup coolant is transferred from the storage vessel to the cooling segments, and coolant is naturally transferred between the cooling segments as needed to restore the liquid coolant inventory.

In another embodiment, a backup cryogenic refrigeration system for a high temperature superconducting cable is provided, the system comprising a:

A. Backup refrigeration vessel optionally comprising a backup re-condensing coil;

B. First heat exchanger comprising a first heat-exchange coil in a cooling relationship with a first refrigeration unit;

C. First circulation loop in a cooling relationship with both a first segment of the cable and the first heat exchanger;

D. Second heat exchanger comprising a second heat-exchange coil in a cooling relationship with a second refrigeration unit;

E. Second circulation loop in a cooling relationship with both a second segment of the cable and the second heat exchanger; and F. Pipe connecting the first and second circulation systems; the backup refrigeration vessel in fluid communication with at least one of the first and second circulation loops. In one embodiment, the first and second refrigeration units are mechanical refrigeration units. If the optional backup re-condensing coil is present in the backup refrigeration vessel, then the system may further comprise a backup refrigeration unit, typically a mechanical refrigeration unit, in a cooling relationship with the backup re-condensing coil. The first or second refrigeration unit may also serve as the backup refrigeration unit.

In yet another embodiment, a method for providing backup cryogenic refrigeration for a high temperature superconducting cable is provided, the method comprising providing a liquid cryogenic backup vessel containing a liquid cryogenic coolant, the backup vessel in fluid communication with at least one segment of a multi-segmented cooling system for the cable, the liquid cryogenic coolant circulating within the individual segments and the individual segments of the cooling system in fluid communication with one another, the backup vessel in fluid communication with at least one of the segments of the cooling system such that upon loss of coolant in any one of the connected segments, coolant is transferred from the backup vessel to the segment that lost the coolant.

In still another embodiment of the invention, the cryogenic refrigeration system can provide primary (as opposed to backup) cooling to a multi-segmented HTS cable. In this embodiment, the refrigeration unit for each segment is a subcooler and as coolant is lost from the unit (and thus lost from the cable segment), lost coolant is replaced with coolant from the liquid storage vessel.

DETAILED DESCRIPTION OF THE INVENTION

Various embodiments of the invention are described by reference to the drawings in which like numerals are employed to designate like parts. Various items of equipment, such as fittings, mountings, sensors, valves, etc., have been omitted to simplify the description. However, such conventional equipment and its use are known to those of skill in the art, and such equipment can be employed as desired. Moreover, although the invention is described below in the context of cooling a multi-segment HTS cable, those skilled in the art will recognize that the invention has applicability to other devices that require backup cryogenic refrigeration capability for subcooled liquid nitrogen cooling systems.

Figure 1A:
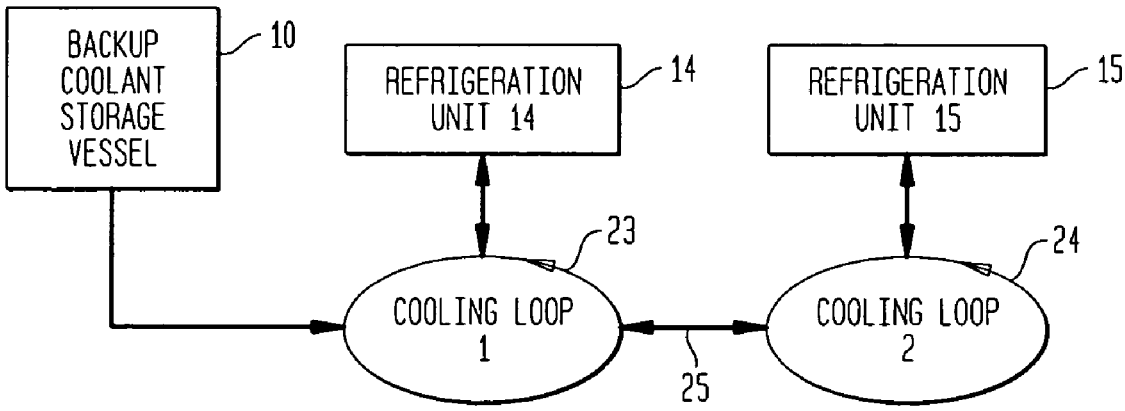
FIG. 1A is a schematic of a rudimentary backup cryogenic refrigeration system for multiple cooling loops.

FIG. 1A is a schematic of the invention comprising its most basic elements. Backup coolant storage vessel 10 (also referred to as a backup refrigeration vessel) is in fluid communication with cooling loop 1 that in turn is in fluid communication with cooling loop 2. Cooling loops 1 and 2 are in fluid communication with refrigeration units 23 and 24 respectively, and each cooling loop is in fluid communication with the other through pipe 25.

Figure 1B:
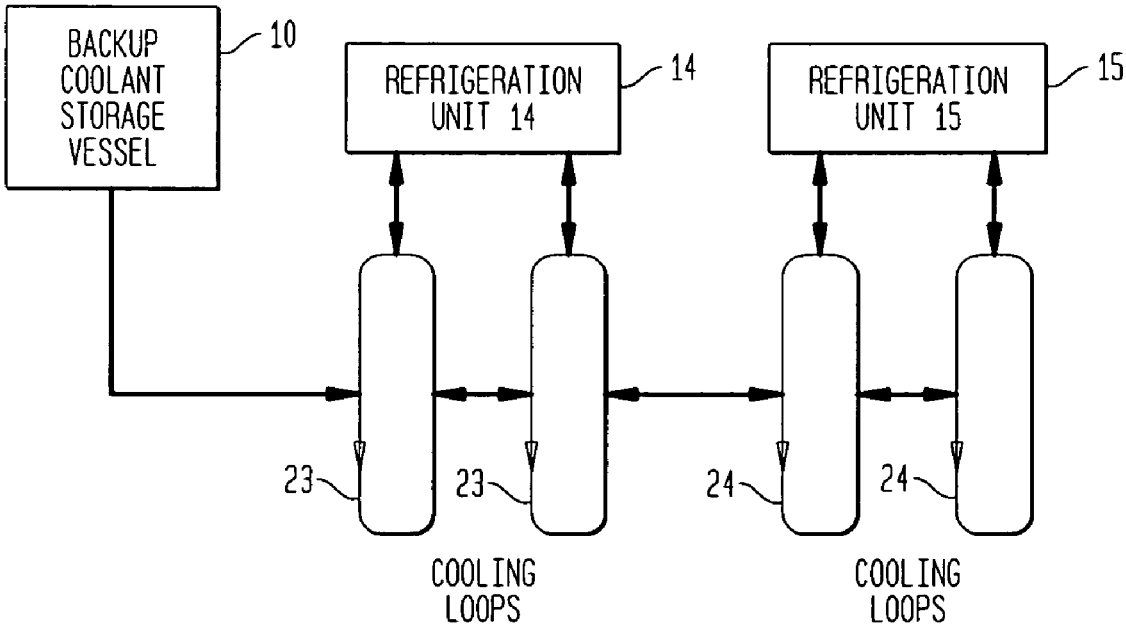
FIG. 1B is a variation of the schematic of FIG. 1A in which the refrigeration units each serve more than one cooling loop.

In operation, each cooling loop encircles, surrounds, passes through or in another configuration is about a device (not shown), e.g., an HTS cable segment, and imparts cooling to the device by circulating a coolant, e.g., a volatile liquid coolant such as liquid nitrogen, through the cooling loop. The coolant from each loop is circulated through a refrigeration unit of any type, e.g., mechanical refrigerator, subcooler, etc., in which the coolant is cooled or re-condensed and returned to the loop. Each loop is typically operated at the same average pressure and as such, coolant does not pass from one loop to another through pipe 25. However, if a leak or other loss of coolant is experienced in either loop, then the resulting loss of pressure triggers the release of backup coolant from liquid coolant storage vessel 10 into system. This can occur naturally, or through the action of a control system and valve arrangement that could monitor system pressure or coolant inventory. If the loss is incurred in cooling loop 1, then the backup coolant flows into cooling loop 1 from storage vessel 10. If the loss is incurred in cooling loop 2, then coolant from loop 1 flows into loop 2, and coolant from storage vessel 10 flows into loop 1. Coolant moves from one loop to another as required to balance the pressure of the two loops. As shown in FIG. 1B, this coolant transfer mechanism works in the same manner if more than two cooling loops are connected in series, and each refrigeration unit can service more than one cooling loop.

Figure 2A:
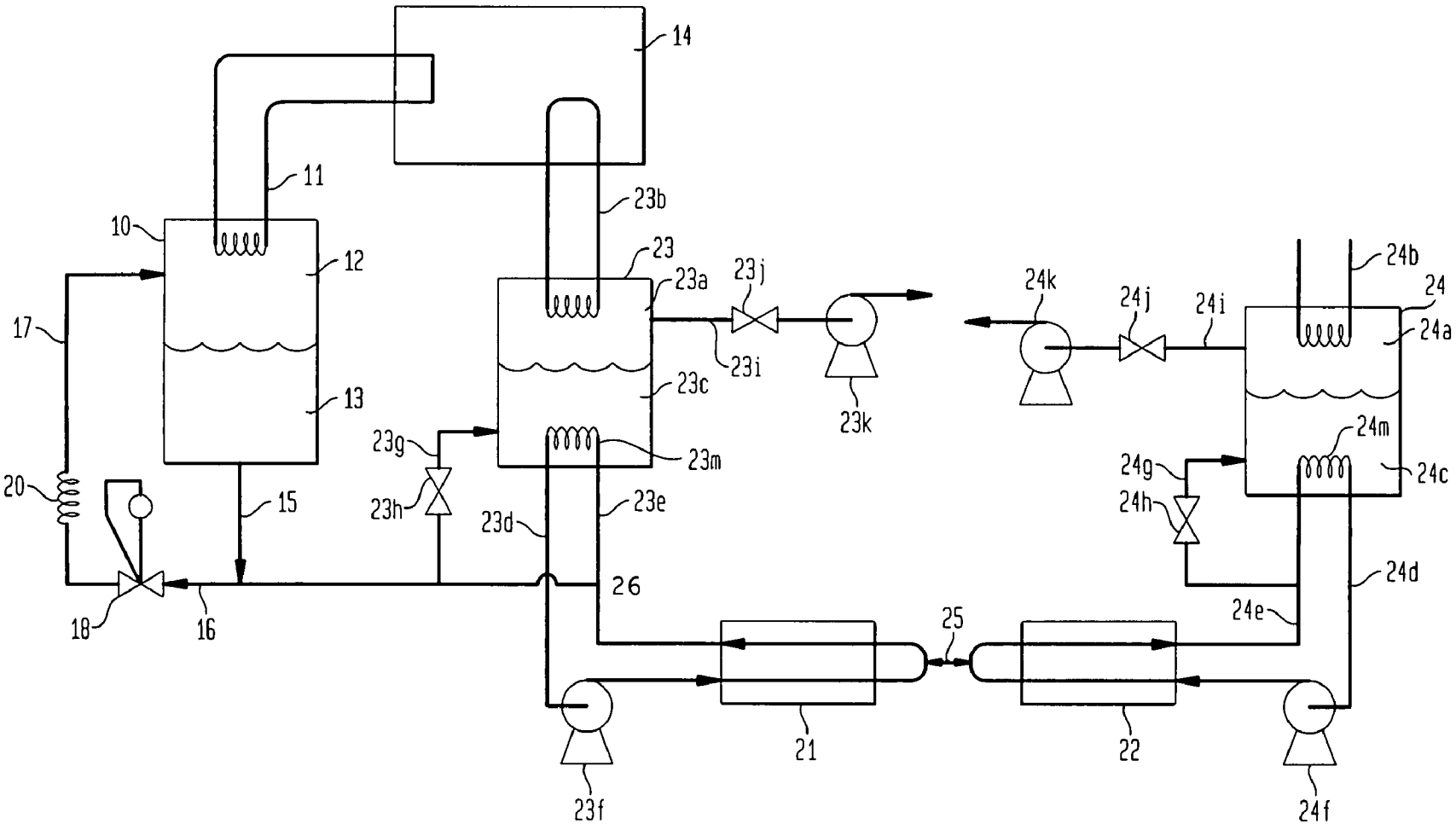
FIG. 2A is a schematic of one embodiment of a backup cryogenic refrigeration system for a multi-segment HTS cable.

FIG. 2A is an elaboration of FIG. 1. FIG. 2A describes a multi-segmented, subcooled liquid loop for an HTS cable. Although FIG. 2A depicts only two segments, this is for simplicity. As noted above, this invention is applicable to a system comprising any number of segments. Moreover, while the segments are shown to be approximately equal in length, the segments may also vary in length or, for that matter, in any other manner, e.g., pipe size, configuration, etc. In addition, the various segments can include different types of devices, e.g., cables and other HTS devices.

In FIG. 2A, backup refrigeration vessel 10 comprises optional backup re-condensing coil 11 located in headspace 12 and holds liquid nitrogen 13. Pressure regulator 18 operates in a standard manner to allow liquid nitrogen to flow through lines 15 and 16, into vaporizing coil 20, to cycle pressuring nitrogen gas into headspace 12 to assist in maintaining the upper pressure desired in vessel 10. Re-condensing coil 11 is in a cooling relationship with backup mechanical refrigeration unit 14, i.e., mechanical refrigeration unit 14 cools re-condensing coil 11 sufficiently so that re-condensing coil 11 condenses nitrogen that has evaporated from liquid nitrogen 13 and returns it to liquid nitrogen 13. Alternatively, re-condensing coil 11 may be in cooling relationship with a separate mechanical refrigeration unit, not shown.

Except for the backup refrigeration vessel assembly described above which is in fluid communication with cable segment or circulation loop 1, first and second cable segments 21 and 22 are essentially mirror images of one another. The HTS cable itself is not shown. The subcooling assemblies of first and second cable segments 21 and 22 comprise, respectively, heat exchangers, or more specifically here, re-condensing thermosyphons, 23 and 24. Each thermosyphon comprises a headspace 23*a* and 24*a* into which re-condensing coils 23*b* and 24*b* extend, respectively, in a cooling relationship similar to that described between the backup re-condensing coil and the backup refrigeration unit. In the embodiment of FIG. 2A, re-condensing coil 23*b* extends into backup refrigeration unit 14. In this preferred configuration, one refrigeration unit operates on two re-condensing coils and thus saves capital and operation costs. In an alternative embodiment not shown, re-condensing coils 11 and 23*b* are each serviced by separate refrigeration units. In yet another embodiment, a single refrigeration unit can operate on three or more re-condensing coils. In yet another embodiment, two or more mechanical refrigeration units can operate on one thermosyphon. The refrigeration unit for servicing re-condensing coil 24*b* is not shown. Liquid nitrogen 23*c* and 24*c* is held in vessels 23 and 24, respectively. Those skilled in the art will recognize that condensing coils 11, 23*b* and 24*b* can be located external to, but in fluid communication with, their respective pressure vessels. Additionally, the coils shown may be cooled by circulating refrigeration fluid used in the mechanical refrigeration units (e.g., helium), or may simply be cold surfaces ("cold heads") that are maintained at a reduced temperature through the action of the mechanical refrigeration units.

Liquid nitrogen is circulated through circulation loops around first and second cables segments 21 and 22, respectively, through pipes 23*d-e* and 24*d-e*, respectively. Pipes 23*d-e* and 24*d-e* are connected by pumps 23/ and 24/ respectively. Pipes 23*e* and 24*e* are connected by interconnecting pipe 25. Pipes 16 and 23*e* form open junction 26 through which backup vessel 10 is in fluid communication with first cable segment 21. Junction 26 is the location where backup vessel 10 maintains the pressure in the circulation loops, and also serves as the point where natural liquid expansion and contraction is accommodated through the use of vessel 10 as an expansion tank.

In the normal operation of the subcooled loops for first and second cable segments 21 and 22, subcooled liquid nitrogen, is circulated through pipes 23*d-e* and 24*d-e* by pumps 23/and 24/respectively. The temperature of the liquid nitrogen is coldest as it leaves the respective thermosyphons and warmest as it returns to the respective thermosyphons. As the liquid nitrogen passes over the length of the respective cable segments, it absorbs heat from the respective cable segments and warms, and thus needs to be relieved of this heat upon its return to the thermosyphons. This is accomplished by passing the warmed liquid through evaporating coils 23*m* and 24*m* inside the thermosyphons. The warmed liquid will be cooled by heat exchange with the cooler liquid 23*c* and 24*c*, which in turn will cause some of liquid 23*c* and 24*c* to boil. Because of the action of evaporating coils 23*m* and 24*m*, liquid nitrogen is constantly evaporating into the head space of the respective thermosyphons. This evaporation would cause the pressure to raise inside the thermosyphons, which is prevented through the action of re-condensing coils 23*b* and 24*b*, respectively. Re-condensing coils 23*b* and 24*b* are supplied with refrigeration from the mechanical refrigeration units (e.g., mechanical refrigeration unit 14 for re-condensing coil 23*b*) at a rate just sufficient to condense the evaporating liquid and maintain the desired thermosyphon temperature and pressure. The refrigeration from the mechanical refrigeration units are controlled at a rate and amount to maintain either the thermosyphon pressure, or alternative the cooling loop temperature. This control action is through well known on/off or proportional-integral-differential (PID) type control logic. Because nitrogen is neither lost or gained from thermosyphon vessels 23 and 24 during this mode of operation, the level of liquid nitrogen in the thermosyphons remains constant. During normal, stable operation, liquid nitrogen does not pass through interconnecting conduit 25 from and/or to pipes 23*e* and 24*e* because a nominally constant pressure is maintained in both loops (exclusive of the pressure drop imposed by the circulating fluid). A nominal amount of liquid nitrogen may pass either direction through conduit 25, and similarly through junction 26, during normal operation in response to changes in operating temperature or conditions that can cause the liquid nitrogen in pipes 23*e* and 24*e* to expand or contract.

In the event of a failure of one of the refrigeration units responsible for maintaining the liquid nitrogen in one of the thermosyphons, one set of valve pairs, i.e., 23*h/j* or 24*h/j*, will activate, the pair actually activated depending upon which loop has lost its refrigeration source. For purposes of illustration, if the failure is of the refrigeration unit responsible for maintaining the liquid nitrogen in thermosyphon 24, then the closed bath of liquid nitrogen in thermosyphon 24, which normally is maintained at a constant pressure through a balance between boiling and re-condensation, will tend to rise in pressure. With failure of the refrigeration unit associated with thermosyphon 24, the rising pressure will cause valve 24*j* to open and vacuum pump 24*k* to begin operation. The opening of valve 24*j* and operation of pump 24*k* will be controlled at a rate and amount to return the rising pressure to the desired value. This control action is through well known on/off or PID type control logic. The use of vacuum pump 24*k* assumes the need to maintain thermosyphon 24 at a pressure below atmospheric. If the pressure to be maintained is at or above normal atmospheric pressure, then vacuum pump 24*k* may be eliminated. As shown, vacuum pumps 23*k* and 24*k* must operate at cold conditions. They may operate at warmer conditions if the vent stream passing through pipe 231 and 24; is warmed. The combined action of valve 24*j* and vacuum pump 24*k* will maintain the bath pressure but the liquid level will drop and ultimately lose the ability to cool the subcooled liquid loop for second cable segment 22.

The level of liquid nitrogen 24*c* is maintained in thermosyphon 24 by opening valve 24*h*, which will admit the higher pressure liquid nitrogen from loop 22 into the bath. The opening of valve 24*h* will be controlled at a rate and amount to return the lowering level of liquid nitrogen 24*c* to the desired level. This control action is through well known on/off or PID type control logic. The thermodynamics and flow rates of the process ensure that the mass flow of makeup liquid, i.e., liquid nitrogen, will be much less than the flow rate of the circulated subcooled liquid nitrogen. Conservation of mass will cause an equal amount of liquid to be withdrawn from the subcooling loop of second cable segment 22, which in turn is replenished from the subcooling loop for first cable segment 21 by way of connecting pipe 25. This liquid nitrogen, in turn, is withdrawn from backup refrigeration vessel 10 through pipes 15, 16 and junction 26. The entire process occurs with no additional required control logic, and it has little or no effect on the cable cooling characteristics of the subcooled liquid loops. If desired, the amount of liquid being circulated through cooling circuits around first and second cable segments 21 and 22 may be adjusted with pumps 23/and 24/during back-up operation to compensate for the small change in flow caused by this process. The only significant impact is a loss of liquid backup which will cause normal pressure building coil 20 to operate to a greater extent. There is also a requirement to replenish the liquid inventory in backup vessel 10 at a time that will depend on the amount of liquid being withdrawn and the size of the vessel.

Figure 2B:
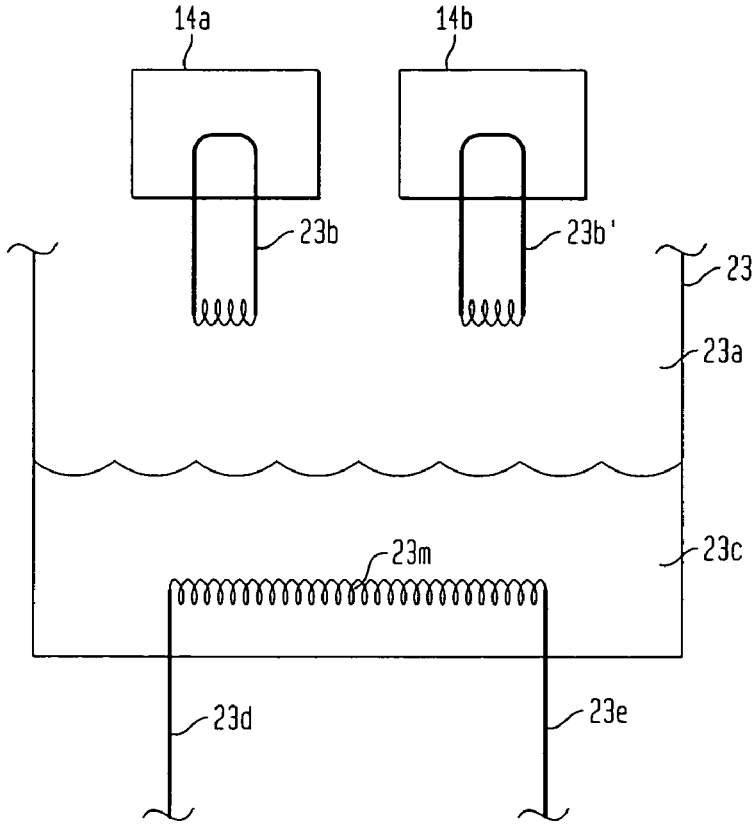
FIG. 2B illustrates a variation on the schematic of FIG. 2A in which one thermosyphon and cooling circuit is refrigerated using two mechanical refrigeration units.

FIG. 2B illustrates an alternative embodiment in which each thermosyphon and cooling circuit is refrigerated using two (or more) mechanical refrigeration units. In FIG. 2B, thermosyphon 23 has re-condensing coils 23*b* and 23*b*' extending into headspace 23*a* from mechanical refrigeration units 14*a* and 14*b*. In this arrangement, the failure or required maintenance of one refrigeration unit will generally only require the backup refrigeration system to replace the refrigeration capacity of that mechanical refrigeration units that is inactive. In this case, both the backup refrigeration unit and the remaining active mechanical refrigeration unit will operate together. In yet another embodiment, both the mechanical refrigeration unit or units servicing a cooling loop can be operated in conjunction with the backup refrigeration system to provide increased overall refrigeration capacity as the need arises, e.g., in a peak-shaving situation.

The subcooled liquid nitrogen loop described above is cooled by hybrid heat exchangers, i.e., the thermosyphons. Alternative heat exchangers can also be used in the practice of this invention. While these do not offer the dual cooling mode flexibility of a thermosyphon, they are equally viable heat exchange options for each mode of cooling. Since each is focused on its own particular source of cooling, they are illustrative of the dual modes of operation of the proposed thermosyphon.

Figure 3:
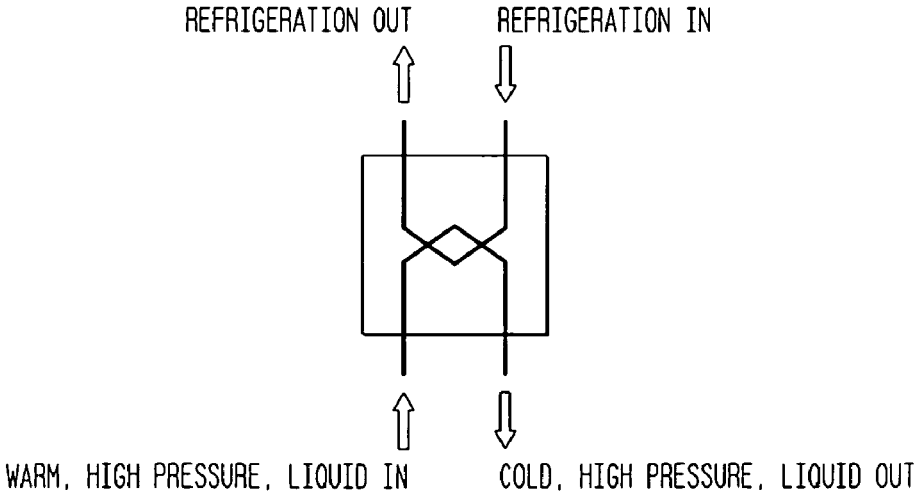
FIG. 3 is a schematic of a simple counter flow heat exchanger.

FIG. 3 is a schematic of a simple and traditional counter flow heat exchanger for a mechanical refrigeration source. The features of this mechanical refrigeration source are not important in the context of this invention and for the purposes of this invention, the coolant, e.g., helium gas, enters the heat exchanger at a prescribed temperature and flow rate. After performing its cooling duty in the heat exchanger, the coolant leaves the exchanger at a warmer temperature than it enters the heat exchanger, the exact exit temperature dependent upon such variables as the nature of the coolant, flow rate and cooling duty (typically measured in watts). Other types of heat exchangers can be used in the practice of this invention depending upon the nature of the mechanical refrigeration unit. For example, in the event the mechanical refrigeration source uses a "cold head", then the heat exchanger can be as simple as a coil of tubing around the cold head.

Figure 4:
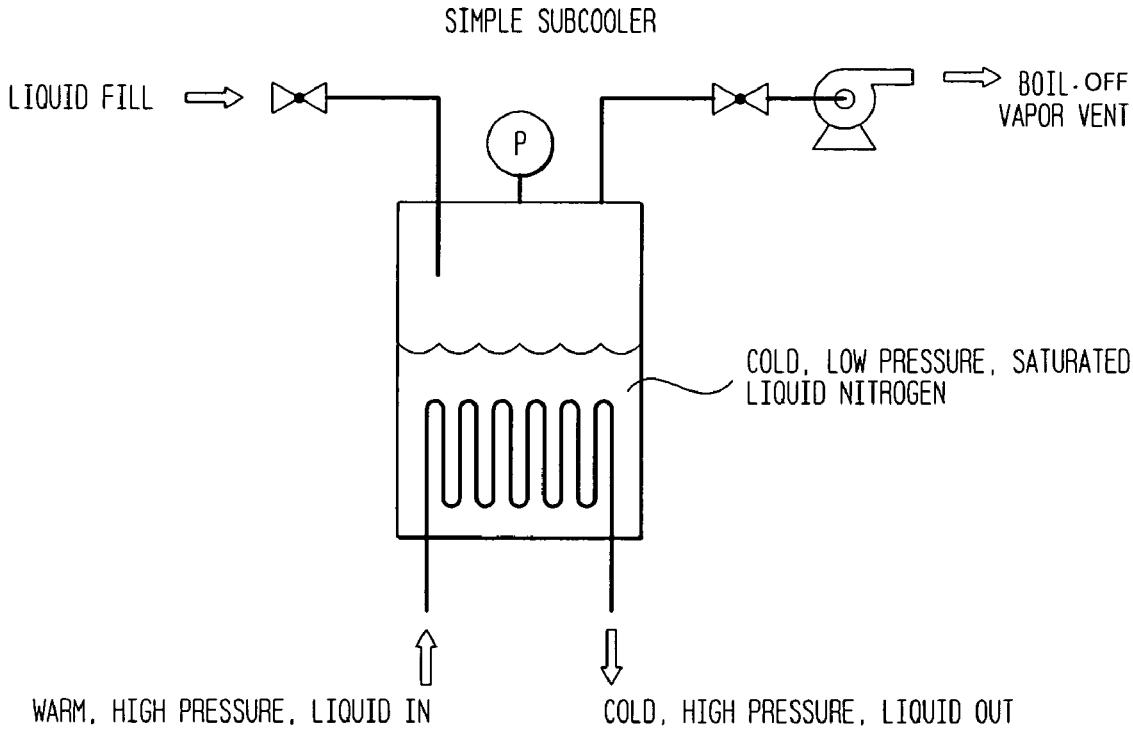
FIG. 4 is a schematic of a heat exchanger in which the source of refrigeration is bulk liquid nitrogen.

FIG. 4 illustrates the simplest heat exchanger in which the source of refrigeration is bulk liquid nitrogen. This form of traditional subcooler is well known in the industry. In the practice of the invention, the bath is operated at an unusually low pressure (subatmospheric for bath temperatures below 77K). The liquid supply (which may be at any arbitrary supply pressure greater than the bath pressure) simply operates to maintain a prescribed bath level. The bath will generally operate in a saturation state, i.e., the liquid will be at its boiling point that uniquely depends on the bath pressure.

In the simplest possible subcooler, the bath is exposed to ambient conditions and any vent or vapor simply exits through an opening to the outside. In this case, the pressure is atmospheric and the boiling point is about 77K. To operate at a reduced pressure (which implies a lower bath temperature), a vacuum pump/blower is throttled to maintain a prescribed bath pressure. As opposed to the simple heat exchanger of FIG. 3, the thermodynamic process is more complex. Because the bath is at its boiling point, which is generally colder than the incoming liquid to be cooled, there is a boil-off occurring that is proportional to the amount of cooling required. Modest complexity is present in that the vent flow rate through the pump/blower is the sum of two flows. The first is from the boil-off occurring in the bath from the heat exchanger coils, and the second comes from the liquid nitrogen supplied to keep the bath full. Depending on the supply liquid nitrogen temperature and pressure, the liquid nitrogen will "flash" as it depressurizes into the lower pressure environment of the bath. Thermodynamically, this is termed an isenthalpic (constant enthalpy) expansion. Some "flash" gas may also be formed upstream in the liquid nitrogen piping. The subsequent liquid plus vapor that enters the bath from the fill line is saturated and at a temperature equal to the bath temperature.

Although the invention has been described in considerable detail through the proceeding embodiments, this detail is for the purpose of illustration. Many variations and modifications can be made without departing from the spirit and scope of the invention as described in the pending claims. All of the U.S. patents and allowed U.S. patent applications cited above are incorporated herein by reference.

What is claimed is:

1. A backup cryogenic refrigeration system for a high temperature superconducting cable, the system comprising a:

A. Backup refrigeration vessel;

B. First heat exchanger comprising a first heat-exchange coil in a cooling relationship with a first refrigeration unit;

C. First circulation loop in a cooling relationship with both a first segment of the cable and the first heat exchanger;

D. Second heat exchanger comprising a second heat-exchange coil in a cooling relationship with a second refrigeration unit;

E. Second circulation loop in a cooling relationship with both a second segment of the cable and the second heat exchanger; and F. Pipe connecting the first and second circulation systems, the backup refrigeration vessel in fluid communication with at least one of the first and second circulation loops.

2. The system of claim 1 in which the first and second refrigeration units are mechanical refrigeration units.

3. The system of claim 1 in which the backup refrigeration vessel further comprises a backup re-condensing coil.

4. The system of claim 3 in which the backup re-condensing coil is in a cooling relationship with a backup refrigeration unit.

5. The system of claim 4 in which the backup refrigeration unit is the first or second refrigeration unit.

6. The system of claim 1 in which the backup refrigeration vessel further comprises a pressure-building coil.

7. The system of claim 1 in which at least one of the heat exchangers is a thermosyphon.

8. The system of claim 1 in which both of the heat exchangers are thermosyphons.

9. The system of claim 2 in which at least one of the heat exchangers is a combination of (i) a means for a direct heat exchange between the circulation loop and the mechanical refrigeration unit, and (ii) a bath of volatile coolant fluid in a heat exchange relationship with the circulation loop.

10. The system of claim 2 in which both of the heat exchangers are a combination of (i) a means for a direct heat exchange between the circulation loop and the mechanical refrigeration unit, and (ii) a bath of volatile coolant fluid in a heat exchange relationship with the circulation loop.

11. The system of claim 1 containing a cryogenic coolant.

12. The system of claim 11 in which the coolant is liquid nitrogen.

13. A method for providing backup cryogenic refrigeration for a high temperature superconducting cable, the method comprising providing a backup coolant storage vessel containing a liquid cryogenic coolant, the backup vessel in fluid communication with at least one segment of a multi-segmented cooling system for the cable, the liquid cryogenic coolant circulating within the individual segments and the individual segments of the cooling system in fluid communication with one another, the backup vessel in fluid communication with at least one of the segments of the cooling system such that upon loss of coolant in any one of the connected segments, coolant is transferred from the backup vessel to the segment that lost the coolant.

14. The method of claim 13 in which the coolant is liquid nitrogen.

15. The method of claim 14 in which the nitrogen is maintained liquid at a prescribed temperature within the individual segments of the cooling system through the action of at least one thermosyphon.

16. The method of claim 13 in which the coolant of the backup coolant storage vessel is maintained at a pre-determined maximum pressure through a heat exchange relationship with a refrigeration unit.

17. The method of claim 13 in which the at least one segment of a multi-segmented cooling system comprises a thermosyphon in a cooling relationship with at least two mechanical refrigeration units, and coolant in the cooling system is maintained at a pre-determined temperature by passing warm coolant from the segment to the thermosyphon in which the warmth of the coolant is reduced through a heat exchange relationship with the mechanical refrigeration units.

18. The method of claim 17 in which only one of the at least two mechanical refrigeration units that are in a cooling relationship with the thermosyphon is operating.

19. The method of claim 13 in which all of the refrigeration units are mechanical refrigeration units, and all of the mechanical refrigeration units are operating simultaneously and at least one of the refrigeration units is operating in a subcooling mode using coolant from the backup coolant storage vessel.

20. A cryogenic refrigeration system for a high temperature superconducting cable, the system comprising a:

A. Refrigeration vessel;

B. First heat exchanger comprising a first heat-exchange coil in a cooling relationship with a first subcooler;

C. First circulation loop in a cooling relationship with both a first segment of the cable and the first heat exchanger;

D. Second heat exchanger comprising a second heat-exchange coil in a cooling relationship with a second subcooler;

E. Second circulation loop in a cooling relationship with both a second segment of the cable and the second heat exchanger; and F. Pipe connecting the first and second circulation systems, the backup refrigeration vessel in fluid communication with at least one of the first and second circulation loops.

21. A method for providing cryogenic refrigeration for a high temperature superconducting cable, the method comprising providing a coolant storage vessel containing a liquid cryogenic coolant, the storage vessel in fluid communication with at least one segment of a multi-segmented cooling system for the cable, the liquid cryogenic coolant circulating within the individual segments and the individual segments of the cooling system in fluid communication with one another, the storage vessel in fluid communication with at least one of the segments of the cooling system such that upon loss of coolant in any one of the connected segments, coolant is transferred from the storage vessel to the segment that lost the coolant.

* * * * *